US007061401B2

(12) United States Patent
Voos et al.

(10) Patent No.: US 7,061,401 B2
(45) Date of Patent: Jun. 13, 2006

(54) METHOD AND APPARATUS FOR DETECTING A FLIGHT OBSTACLE

(75) Inventors: Holger Voos, Salem (DE); Rene Koch, Überlingen (DE); Claus Dähne, Überlingen (DE); Martin Arndt, Owingen (DE); Michael Gross, Salem (DE)

(73) Assignee: Bodenseewerk Gerätetechnik GmbH, Überlingen (DE)

( * ) Notice: Subject to any disclaimer, the term of this patent is extended or adjusted under 35 U.S.C. 154(b) by 141 days.

(21) Appl. No.: 10/889,449

(22) Filed: Jul. 12, 2004

(65) Prior Publication Data

US 2005/0109872 A1 May 26, 2005

(30) Foreign Application Priority Data

Aug. 7, 2003 (DE) ..... 103 36 928

(51) Int. Cl.
*G08G 5/04* (2006.01)

(52) U.S. Cl. ..... 340/961; 701/301; 382/103; 382/104; 382/181; 382/190; 348/117; 348/144; 348/148; 348/149

(58) Field of Classification Search ..... 340/961; 701/301; 382/103, 104, 181; 348/117
See application file for complete search history.

(56) References Cited

U.S. PATENT DOCUMENTS

| | | | | |
|---|---|---|---|---|
| 3,992,707 A | | 11/1976 | Schmidtlein et al. | |
| 4,405,943 A | * | 9/1983 | Kanaly | 375/240.08 |
| 4,918,442 A | | 4/1990 | Bogart, Jr. | |
| 5,414,439 A | | 5/1995 | Groves et al. | |
| 5,581,250 A | | 12/1996 | Khvilivitzky | |
| 5,883,586 A | | 3/1999 | Tran et al. | |
| 6,400,831 B1 | * | 6/2002 | Lee et al. | 382/103 |
| 6,804,607 B1 | * | 10/2004 | Wood | 701/301 |
| 2002/0069019 A1 | | 6/2002 | Lin | |

FOREIGN PATENT DOCUMENTS

| | | |
|---|---|---|
| DE | 42 40 789 A1 | 12/1992 |
| DE | 197 41 896 C2 | 9/1997 |
| DE | 695 06 174 T2 | 4/1999 |
| DE | 100 65 180 A1 | 12/2000 |
| EP | 1 296 213 A1 | 7/2002 |

* cited by examiner

*Primary Examiner*—Daniel Wu
*Assistant Examiner*—Hongmin Fan
(74) *Attorney, Agent, or Firm*—Scully, Scott, Murphy & Presser

(57) ABSTRACT

An apparatus for and a method of detecting a flight obstacle (28, 30, 32, 34) in the surroundings (50) of an aircraft (4), in particular for collision warning purposes, wherein images of the surroundings (50) are recorded, the flight obstacle (28, 30, 32, 34) is detected from the images and provided with an identification, and a signal (66, 68, 76) associated with the identification is outputted in a ground station (6). In order to guarantee a high level of certainty in respect to the control of the aircraft (4) which is effected automatically or by a ground control pilot it is proposed that detection and allocation of the identification are effected on board the aircraft (4) and the identification is sent to the ground station (6).

14 Claims, 2 Drawing Sheets

METHOD AND APPARATUS FOR DETECTING A FLIGHT OBSTACLE

BACKGROUND OF THE INVENTION

1. Field of the Invention

The invention relates to a method of detecting a flight obstacle in the surroundings of an aircraft, in particular an unmanned aircraft, wherein at least two images of at least one respective part of the surroundings are recorded, the flight obstacle is detected from the images and provided with an identification, and a signal associated with the identification is outputted in a ground station.

The invention further concerns an apparatus for detecting a flight obstacle in the surroundings of an aircraft, in particular an unmanned aircraft, comprising at least one camera unit for recording at least a part of the surroundings and an evaluation apparatus for detecting the flight obstacle and associating an identification with the flight obstacle.

2. Discussion of the Prior Art

EP 1 296 213 A1 discloses a method of representing a flying object, wherein a space surrounding an unmanned aircraft is recorded by a number of cameras and the images are sent to a ground station and represented for a ground control pilot on a display. The ground control pilot can control the aircraft on the basis of the represented images, in which respect his attention is drawn to flying objects in the proximity of the aircraft by auxiliary means such as for example flashing symbols in the represented image. Continuous active observation of electronically generated images in which a flying object can only be occasionally detected is however very tiring for a ground control pilot so that he can take account of his responsibility for the safety of the aircraft in respect of a collision warning only with a considerable amount of concentration over a long period of time.

SUMMARY OF THE INVENTION

Therefore the object of the invention is to provide a method of representing a flight obstacle, which is improved in particular in respect of handleability. Another object of the invention is to provide an apparatus with which such a method can be easily initiated.

The first-mentioned object is attained by a method of the kind set forth in the opening part of this specification in which, in accordance with the invention, detection and allocation of the identification are effected on board the aircraft and the identification is sent to the ground station.

By virtue of the identification and optionally further items of detail information being transmitted to the ground station, the information made available to the ground control pilot is reduced to a necessary and meaningful minimum. The ground control pilot is therefore no longer confronted with the task of having to actively observe an air space around the aircraft, on the basis of images. In that way the efficiency of work of the ground control pilot can be increased and thus the level of safety can be enhanced. In addition, eliminating the transmission of moving images from the whole of the space surrounding the aircraft means that the amount of data communicated from the aircraft to the ground station is kept low. Remote data transmission can thus be effected with a low capacity and inexpensively.

Flying objects such as aircraft, helicopters, balloons or the like and ground-connected objects such as towers, buildings, bridges, masts, cables and so forth can be detected as flight obstacles. It is sufficient if the flight obstacles are detected as such. The flight obstacles are to be detected if they are in the space around the aircraft, accordingly in a range of up to a maximum of 3 km, advantageously up to 5 km and in particular up to 8 km, for example depending on the viewing conditions and/or the size and visibility of the flight obstacle. For that purpose, images of the surroundings of the aircraft are recorded, within which flight obstacles are expected as a matter of priority, for example in a spatial angle region of at least 110° in the horizontal direction on both sides of a longitudinal axis of the aircraft and at least 30° in the vertical direction on both sides of the longitudinal axis. The images are preferably recorded by a passive wide-angle sensor system with a high level of resolution. The sensor system is so designed that flight obstacles in the surroundings around the aircraft can be detected to a sufficient extent and at a sufficient distance and with a false alarm rate which is as low as possible, in order to provide sufficient time for an avoidance manoeuvre. The resolution of those images is desirably at least 2 mrad, in particular at least 0.3 mrad, which corresponds to the maximum foveal resolution of the human eye.

The images from which an evaluation apparatus detects the flight obstacle can be obtained by continuous recording of items of image information. It is also possible to record images in any or a predetermined rhythm in respect of time. In that case the image rate, the field of vision and the resolution can be such that the desired surrounding area is covered either with one or a few rigidly arranged cameras with a high number of pixels or with one or a plurality of cameras with a smaller but adequate number of pixels and an additional scanner system.

To detect the flight obstacle, two or more images which are recorded in succession in respect of time can be processed, for example compared to each other, by means of an image processing unit, on board the aircraft. Image processing per se, which permits such detection of an object from images, is known for example from Görz, Rollinger, Schneeberger: 'Handbuch der Künstlichen Intelligenz', Oldenbourg Verlag, 2000, Chapter 21.4. To provide for detection it is also possible for two or more images which were recorded in a differing spectral range, for example in the visual range and in the infrared range, to be compared to each other. After detection an identification is associated with the flight obstacle. Such an identification can be a signal, for example a string of characters. The identification is then forwarded to a transmitting device which sends the identification to the ground station. In that respect there is no need for the transmitting device to send the identification directly to that ground station in which a signal associated with the identification is outputted. The identification can be communicated to the outputting ground station indirectly by way of a further ground station, a satellite, or by way of an aircraft serving as a relay station. At the outputting ground station the associated signal is outputted in such a way that the ground control pilot can perceive it, for example in the form of a visual object on a display means such as a screen or a projection device, or as an acoustic signal, or both together. The method is particularly suitable for use as a collision warning method.

In an advantageous configuration of the invention classification of a risk potential of the flight obstacle is implemented on board the aircraft. Such a classification procedure can serve for a control apparatus on board the aircraft as a basis for deciding whether intervention in the course which is being followed at the present time is to be effected without a corresponding command from a ground control pilot. Desirably the classification of the risk potential is sent to the ground station. In that way a ground control pilot can quickly recognise whether immediate intervention is necessary, due to a danger situation. The risk potential can arise out of the speed of rotation of the line of sight, the apparent size of the flight obstacle, the rate of change thereof in the recorded images, the elevational angle or the height angle, the relative height with respect to the aircraft or a remaining reaction time until a calculated collision. Uncertain detection can also form one or more categories in the classification so that flight obstacles which are uncertainly detected are only signalled to the ground station when they represent a significant risk potential to the aircraft. In that way false alarms can be kept at a low level. The classification can be in the classes 'high', 'medium' and 'low', in a relatively fine or continuous graduation or, in still more differentiated form, according to different kinds of risks.

Important items of information relating to a detected flight obstacle can be ascertained by implementing a measurement with respect to the flight obstacle with an active measurement signal. Such a measurement signal can be emitted from the aircraft and is for example a laser beam or a radar signal. The measurement signal can be used for distance measurement or for measurement of the differential speed between the flight obstacle and the aircraft. Such measurement can be used for calculation of a remaining reaction time until a possible collision. The information obtained can be forwarded to the ground control pilot and/or used for classifying the risk potential. Implementation of the measurement procedure with the active measurement signal can be controlled by the ground control pilot or can be implemented automatically, for example when a predetermined risk potential is exceeded. It is also possible, in relation to any detected flight obstacle, basically to effect active measurement, for example a distance measurement procedure, wherein that kind of measurement operations can serve for disregarding for example flight obstacles which are moving away and which are only of slight or no interest to a ground control pilot. An active sensor system usually has a limited range of vision, and for that reason it is desirably independently movable and can be pivoted in on to a flight obstacle which is of interest.

As a further configuration it is provided that an avoidance trajectory is ascertained on board and in particular data associated with the avoidance trajectory are communicated to the ground station. Ascertaining the avoidance trajectory on board the aircraft means that not only is there no need to calculate a corresponding avoidance trajectory in the ground station, but the basic prerequisite for a flight on the part of the aircraft on autopilot is provided without an absolute necessity for radio contact with the ground station. That can substantially increase the safety of the aircraft as, in the event of a failure of radio contact between a ground station and the aircraft, the aircraft still retains the capability of independently ascertaining an avoidance trajectory and flying along same. Control of the aircraft by means of an autopilot independently around an obstacle can be appropriate when the reaction time to a calculated collision is no longer sufficient to hand over to the ground control pilot the responsibility for deciding on an avoidance manoeuvre. If the situation involves an adequate reaction time, data associated with the avoidance trajectory are desirably communicated to the ground station. The avoidance trajectory can be displayed to a ground control pilot, as a suggested avoidance manoeuvre.

Advantageously, the avoidance trajectory is ascertained, with incorporation of items of information ascertained on board about the surroundings of the aircraft and/or the flight situation of the aircraft. Information about the aircraft surroundings can be further detected flight obstacles and in particular the risk potential thereof or the landscape surrounding the aircraft, such as for example hills and valleys. Information about the flight situation can be the speed of the aircraft, its position in space, the distance thereof from a flight destination or target or the position of flight actuators for influencing the flight path. In that way it is possible to prevent the aircraft, when being guided along the avoidance trajectory, from being put at risk of being wrecked, for example against a hill or a further flight obstacle. Information about the aircraft surroundings and in particular about the flight situation of the aircraft are usually available at a ground station to an only lesser extent than in the aircraft. Thus, calculating the avoidance trajectory on board the aircraft makes it possible to incorporate substantially more complete items of information than would usually be possible in the event of implementing calculations at the ground station.

Usually a ground control pilot will decide about the flight on an avoidance trajectory and initiate such an avoidance manoeuvre. With a very short reaction time however it may be helpful for the safety of the vehicle if a decision as to whether the aircraft is to fly on an avoidance trajectory is made by a control apparatus on board the aircraft. In addition the handling capability of the aircraft can be retained in the event of a disturbed communication between the aircraft and the ground station in a danger situation. Desirably such an automatic system can be manually switched off by the ground control pilot so that the aircraft does not perform unforeseen avoidance manoeuvres which are not explicitly wanted by the ground control pilot.

Appropriate additional information can be offered to the ground control pilot as a basis for deciding whether an avoidance manoeuvre is to be initiated, insofar as a detail image representing the flight obstacle is sent to the ground station and is displayed there. Such a detail image shows only a detail of the overall image of the space being monitored. On the basis of that detail image, in addition to the information in the form of a symbol, the ground control pilot is shown a real image, for example in the infrared or the visual spectral range, on the basis of which he can better estimate the risk potential due to the flight obstacle. That detail image which represents the flight obstacle and preferably a small part of the space surrounding the flight obstacle can be sent to the ground station with the identification, at the request of the ground control pilot or automatically. It is also possible for the detail image to be communicated as from a preset level of risk potential, automatically from the aircraft to the ground station.

The detail image can be recorded by a detail camera which is arranged movably in the aircraft and which can be directed on to the flight obstacle. In that case the detail image is desirably optically zoomable, thereby making it easier for the ground control pilot to easily detect the flight obstacle. In a further embodiment of the invention the detail image is a part of an image used for detecting the flight obstacle. It is possible to forego an additional recording of the detail image, and the detail image can be very rapidly selected from existing data material and communicated to the ground station. It is also possible for the detail image firstly to be selected from existing image material and sent to the ground station, for example automatically with the identification, and for a detail camera to be additionally directed on to the specified flight obstacle, in response to a specific request from the ground control pilot.

A further advantage can be achieved by recording images from which the flight obstacle is recognised, in the infrared spectral range. It is possible to detect flight obstacles which would not be detectable to the human eye, by virtue of poor vision or darkness. An infrared camera unit can be designed on the basis of a line scanner or a wide-angle scanning process.

Additional information which is important for estimating the risk potential, for the ground control pilot, can be obtained by a procedure whereby the detail image is recorded in a spectral range which differs from the spectral range of the images used for detecting the flight obstacle. In darkness or in twilight for example the images used for detecting the flight obstacle can be recorded in the infrared spectral range, in which case the detail is recorded for easier interpretation in the visible spectral range. Conversely, it is also possible for the images used for detection of the flight obstacle to be recorded in the visible spectral range and for the ground control pilot to request a detail image in the infrared spectral range, for example for estimating the risk potential of the flight obstacle.

The detail image can be an individual image which shows the flight obstacle in a similar manner to a photograph. It is equally possible for it to be an image which is prepared by image processing, with for example only contours. Desirably, a moving image of the flight obstacle is sent to the ground station, for example in the nature of a video, whereby the ground control pilot can be supplied with additional information about the movement of the flight obstacle.

The object in relation to the apparatus is attained by an apparatus of the kind set forth in the opening part of this specification in which, in accordance with the invention, the evaluation apparatus is electrically connected to the camera and a transmitting device for sending the identification to a ground station. The electrical connection of the evaluation apparatus to the camera and the transmitting device means that there is no need for data transmission of complete images and thus large amounts of data from the aircraft to the ground station. In addition the aircraft can be guided independently of a radio contact with the ground station, in a danger situation. Furthermore the information afforded to the ground control pilot is limited to an essential medium. The electrical connection can be achieved for example by way of a wire or indirectly by way of an electrical circuit. Instead of the electrical connection, a mechanical connection is equally possible between the evaluation apparatus and the camera and transmitting device, for example by those items of equipment being provided for joint arrangement in the aircraft.

A detail image can be communicated to a ground control pilot quickly and at low cost and complication if the apparatus has a detail image unit for extracting a detail image showing a view of the flight obstacle and for passing the detail image to the transmitting device.

Desirably the apparatus includes a first camera unit for recording an overall image in a first spectral range and a second camera unit for recording an image, in particular a detail image, in a spectral range different from the first one. The image can be an overall image or a detail image, wherein the second camera unit is provided for recording in the visual or infrared spectral range or for recording reflected laser or radar beams.

BRIEF DESCRIPTION OF THE DRAWINGS

Further advantages will be apparent from the specific description of the drawing hereinafter. The drawing shows an embodiment of the invention. The drawing, the description and the claims set forth numerous features in combination. The man skilled in the art will also suitably consider those features individually and combine them together to provide appropriate further combinations.

In the drawing.

DESCRIPTION OF THE SPECIFIC EMBODIMENTS

Figure 1:
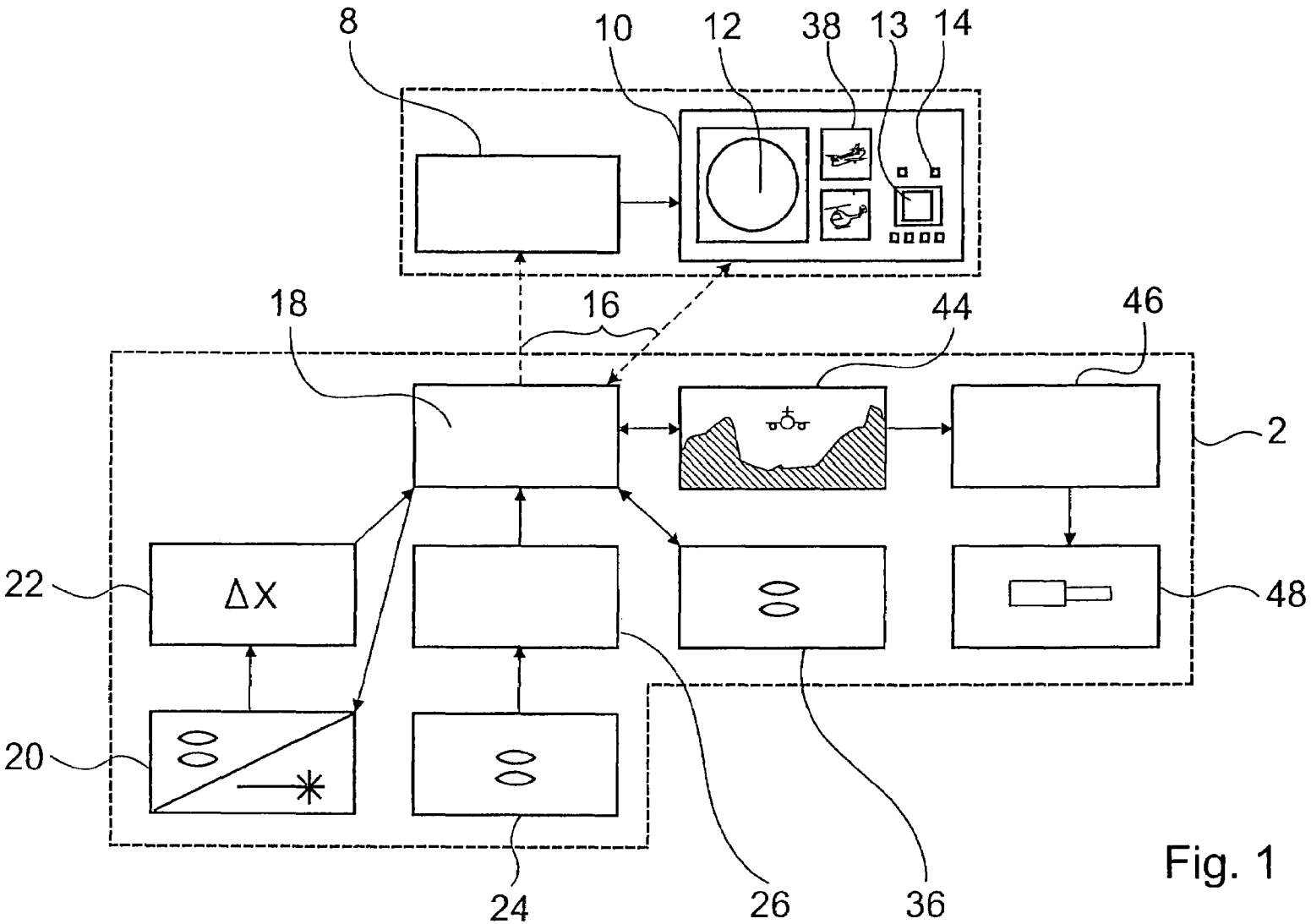
FIG. 1 shows a schematic block diagram of an apparatus for detecting and guiding an aircraft.

FIG. 1 is a block circuit diagram showing an apparatus 2 for detecting and guiding an aircraft 4 (FIG. 2), which apparatus is arranged entirely on board the aircraft 4. The aircraft 4 is an unmanned aircraft 4, for example a reconnaissance aircraft or a transport aircraft. Arranged at a ground station 6 are an apparatus 8 for graphic representation and an apparatus 10 for communication with a ground control pilot for co-operation with the apparatus 2. The apparatus 10 for communication with a ground control pilot includes a display means 12 in the form of a display screen, two further display screens for displaying detail images 38, a further display screen 13 for text displays of additional items of information and a series of control means 14 for the input of control commands.

The broken-line arrows 16 indicate a radio contact between the ground station 6 and a control apparatus 18 of the apparatus 2. For the purposes of communication by way of remote data transmission with the ground station 6 the control apparatus 18 includes a transmitting device for sending identifications and a receiving device. The control apparatus 18 is electrically connected to a unit 20 for emitting and receiving laser light and a unit 22 for distance calculation. Also electrically connected to the control apparatus 18 is a camera unit 24 for recording an overall image in the spectral range of visible light. Arranged between the camera unit 24 and the control apparatus 18 is an evaluation apparatus 26 which includes an image processing unit. The evaluation apparatus 26 is provided for detecting a flight obstacle 28, 30, 32, 34 (FIG. 2) and for associating an identification with the flight obstacle 28, 30, 32, 34. The apparatus 2 also includes a second camera unit 36 provided for recording a detail image 38.

The control apparatus 18 is provided inter alia for calculating an avoidance trajectory 42 (FIG. 3) and for that purpose is in data communication with a flight information unit 44. The flight information unit 44 includes data about the direct surroundings of the aircraft 4, such as for example the territorial surroundings and data about the flight situation of the aircraft 4, such as for example the instantaneous flight speed and the orientation of the aircraft 4 in space. Also electrically connected to the control apparatus 18 is a flight regulating unit 46 which is provided with motors and hydraulic devices for controlling a flight actuator system 48.

Figure 2:
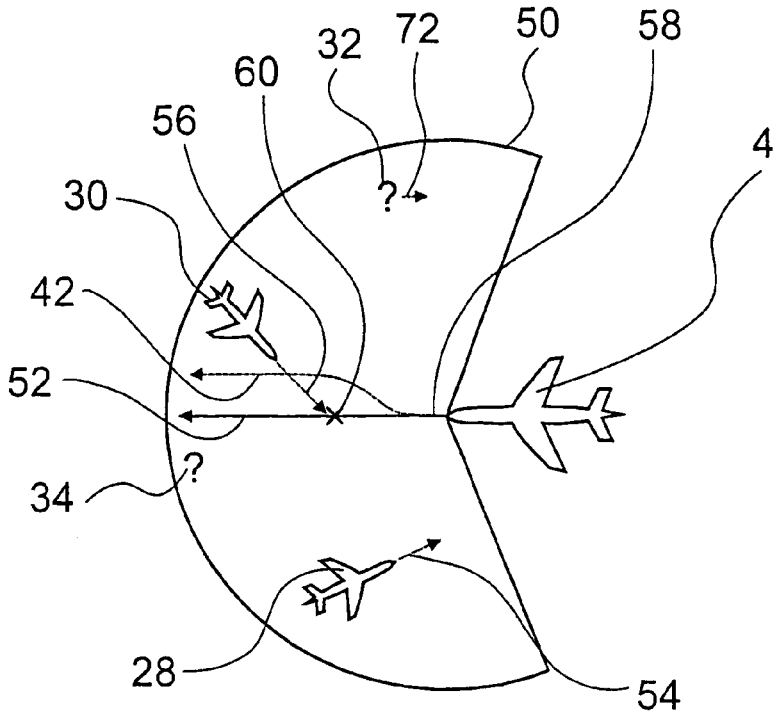
FIG. 2 is a diagrammatic view of the surroundings of an aircraft.
Figure 3:
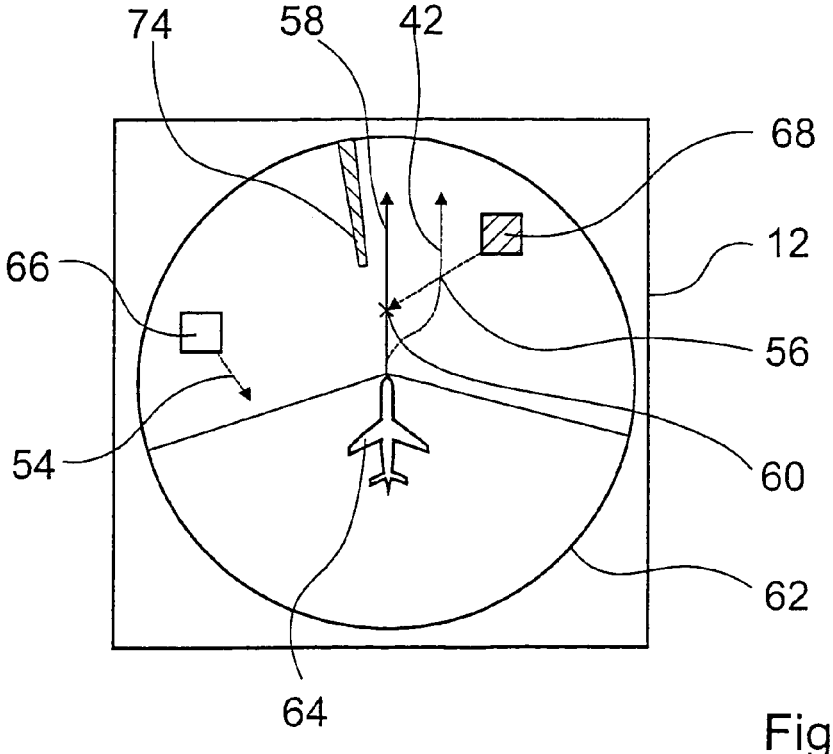
FIG. 3 is a screen representation of the aircraft surroundings shown in FIG. 2.

A method of representing flight obstacles 28, 30, 32, 34 in the surroundings of the aircraft 4 and for guiding the aircraft 4 is described in greater detail hereinafter with reference to the diagrammatic views in FIGS. 2 and 3. Space 50 surrounding the aircraft 4 is recorded in one or more images with a camera unit 24 for recording an overall image. That overall image is arranged symmetrically around the flight direction 52 of the aircraft 4 and covers a spatial angle range of 220° in the horizontal and 60° in the vertical. To record the overall image the camera unit 24 includes four cameras each having a respective sensor array with a level of image resolution of 1 mrad. After a first overall image of the surroundings 50 has been recorded a second and optionally further overall images of the surroundings 50 is or are recorded by the camera unit 24. The overall images are passed to the evaluation apparatus 26 and are there investigated by means of image processing methods for flight obstacles 28, 30, 32, 34 in the surroundings 50 of the aircraft. In that situation, two flight obstacles 28, 30 are detected directly and two further objects are detected as possible candidates for further flight obstacles 32, 34. On the basis of the images successively recorded by the camera unit 24 and processed by the evaluation apparatus 26, the flight obstacles 28, 30, 32, 34 are subjected to further processing and information about them is deposited in the evaluation apparatus 26. In addition the flight obstacles 28, 30, 32, 34 are each provided with a respective identification and that overall information is passed to the control apparatus 18. The control apparatus 18 calculates a risk potential, which can be inferred from the images, in respect of the flight obstacles 28, 30, 32, 34 for the aircraft 4 by means of the speed of rotation of the lines of sight and the distance of the flight obstacles 28, 30, 32, 34, a shape and size varying from one image to another, and the relative height of the flight obstacles 28, 30, 32, 34.

The co-operation of the control apparatus 18 and the evaluation apparatus 26 means that the two flight obstacles 28, 30 are detected as aeroplanes which are moving on a trajectory 54 and 56 respectively. In that respect the flight obstacle 28 does not represent any danger to the aircraft 4 because the flight obstacle 28 is flying substantially lower than the aircraft 4. The risk potential of the flight obstacle 28 is therefore classified as low. It will be noted however that the flight obstacle 30 is calculated as flying on a collision course with the aircraft 4. In that respect it is possible also to ascertain a probable collision point 60. The risk potential of the flight obstacle 30 is therefore classified as very high. Due to that high classification, calculation of the avoidance trajectory 42 is automatically initiated. The calculation procedure is implemented by the control apparatus 18, incorporating items of information about the surroundings 50 and the flight situation of the aircraft 4, which are stored in the flight information unit 44.

The identification associated with the flight obstacles 28, 30 is communicated by radio, together with the ascertained classification of the risk potential of the flight obstacles 28, 30, to the ground station 6 where those data are prepared for graphic representation by means of the apparatus 8 and displayed on the display means 12. A possible representation on the display means 12 is shown in FIG. 3. The display means 12 includes a screen 62 showing an aircraft symbol 64 which is intended to represent the position of the aircraft 4. The flight obstacle 28 is also represented on the screen 62 by an object 66, together with the flight path 54 of the flight obstacle 28. An object 68 which reproduces the position of the flight obstacle 30 is reproduced in a different and more striking colour and/or shape. The objects 66, 68 are conventional symbols which are used in the TCAS (traffic collision avoiding system). In addition, the attention of the ground control pilot is drawn by a synthetic voice to all flight obstacles 30, 34 which exceed a predetermined risk class. It is also possible for the identification communicated from the aircraft 4 to be outputted only in the form of an acoustic signal such as a voice or a sequence of sounds.

From the colours and/or forms of the objects 66, 68 and/or an acoustic signal, it is possible for a ground control pilot to immediately recognise the risk potential of the flight obstacles 28, 30. The flight paths 54, 56 as well as the possible collision point 60 serve as additional information for him. In addition displayed on the screen 13 (FIG. 1) are further items of additional information such as for example the remaining reaction time until the collision point 60 is reached and items of information about the flight situation of the aircraft and possibly about the surroundings of the aircraft 4.

If the remaining reaction time is above a predetermined time value, the ground control pilot can initiate an avoidance manoeuvre, in which respect he is at liberty to follow the proposed avoidance path along the avoidance trajectory 42 or to choose another route. If the remaining reaction time is less than the preset time value, then the flying of an avoidance manoeuvre is automatically initiated by the control apparatus 18. In that respect the control apparatus 18, the flight information unit 44, the flight regulating unit 46 and the flight actuator system 48 co-operate in such a way that the aircraft 4 is guided along the avoidance trajectory 42.

The two flight obstacles 32, 34 which are identified by the evaluation apparatus 26 as not being aircraft are investigated on the basis of further images. In that respect the evaluation apparatus 26 detects that the flight obstacle 32 is moving at a very low flight speed on a flight path 72. That flight path 72 is not coming into the proximity of the flight path 58 of the aircraft 4. It is also recognised that the flight obstacle 32 is far away from the aircraft 4. The risk potential associated with the flight obstacle 32 is therefore classified by the control apparatus 18 as being so low that the identification associated with the flight obstacle 32 is not communicated to the ground station. The decision as to the risk potential from which flight obstacles are displayed on the display means 12 of the ground station 6 can be set by a ground control pilot by way of the control means 14.

The flight obstacle 34 which can also be identified as not being an aircraft has such a very low speed of rotation of line of sight that the risk potential associated with the flight obstacle 34 exceeds the display threshold set by the ground control pilot. By virtue of the fact that the size of the object does not increase in the sequence of recorded images however means that it is not possible to associate a more or less exact distance with the flight obstacle 34, in which respect it is only possible to establish that the flight obstacle, due to the unchanging object size, is at a relatively great distance. The identification associated with the flight obstacle 34 is thus communicated to the ground station and a possible holding region 74 in respect of the flight obstacle 34 is displayed on the screen 62.

In order to obtain additional items of information the ground control pilot can direct on to the flight obstacles 28, 30, 34 the second camera 36 for recording a detail image, which is sensitive in the visible spectral range. The camera unit 36 records an optically zoomable detail image which is up to a maximum of 10° times 10° in size, with a resolution of a maximum of 0.1 mrad, which is transmitted to the control apparatus 18, communicated to the ground station 6, and on the apparatus 10 (FIG. 1). The ground control pilot can see on those detail images 38 that the flight obstacle 30 is a commercial aircraft and the flight obstacle 28 is a helicopter. The detail images 38 are continuously up-dated so that the ground control pilot is shown a respective moving image of each of the flight obstacles 28, 30.

In the event of a fault in the second camera unit 36 a suitable control command from the ground control pilot can be sent by way of the control apparatus 18 to the evaluation apparatus 26 which extracts a detail image respectively showing the flight obstacles 28, 30 from a previously recorded overall image and transmits same to the control apparatus 18 for transmission to the ground station 6. For that purpose the evaluation apparatus 26 includes a detail image unit for extracting a detail image 38 showing a flight obstacle 28, 30, 34, and for forwarding the detail image 38 to the transmitting device.

As the object size of the flight obstacle 34 is specified as being very small, the ground control pilot can forego a representation of the flight obstacle 34 in a further detail image on which the flight obstacle 34 would have been recognisable as a small weather balloon. Instead of this the unit 20 for emitting and receiving laser light can be activated and the distance of the flight obstacle 34 can be ascertained by means of the unit 22. The ascertained distance is transmitted by the unit 22 to the control apparatus 18 which optionally associates with the flight obstacle 34 a new risk potential and sends-it together with the identification of the flight obstacle 34 to the ground station 6. A relatively short time after activation of the unit 20 by the ground control pilot therefore the holding region 74 on the screen 62 is replaced by a further object which reproduces the distance of the flight obstacle 34. The colour and shape of the object is adapted to the classification of the risk potential of the flight obstacle 34.

The four cameras of the camera unit 24 for recording an overall image are sensitive in the visible spectral range. It is equally well possible for those four cameras to be sensitive in the infrared spectral range, whereby it would be possible to achieve a capability for night sight. As described above in that case also detection of the flight obstacles 28, 30, 32, 34 is effected on the basis of a sequence of images recorded by the camera unit 24. As a further variant it is possible for the camera unit 24 to be provided with a number of cameras of which some are sensitive in the infrared spectral range and others in the visual spectral range. In that case detection of the flight obstacles 28, 30, 32, 34 can be effected on the basis of a sequence of images or on the basis of comparisons of images in different spectral ranges.

| List of references | |
|---|---|
| 2 | apparatus |
| 4 | aircraft |
| 6 | ground station |
| 8 | apparatus |
| 10 | apparatus |
| 12 | display means |
| 13 | screen |
| 14 | control means |
| 16 | arrow |
| 18 | control apparatus |
| 20 | unit |
| 22 | unit |
| 24 | camera unit |
| 26 | evaluation apparatus |
| 28 | flight obstacle |
| 30 | flight obstacle |
| 32 | flight obstacle |
| 34 | flight obstacle |
| 36 | camera unit |
| 38 | detail image |
| 42 | avoidance trajectory |
| 44 | flight information unit |
| 46 | flight regulating unit |
| 48 | flight actuator system |
| 50 | surroundings |

-continued

| List of references | |
|---|---|
| 52 | flight direction |
| 54 | flight path |
| 56 | flight path |
| 58 | flight path |
| 60 | collision point |
| 62 | screen |
| 64 | aircraft symbol |
| 66 | object |
| 68 | object |
| 72 | flight path |
| 74 | holding region |

The invention claimed is:

1. A method of detecting a flight obstacle (28, 30, 32, 34) in the surroundings (50) of an unmanned aircraft (4), wherein at least two images of at least one respective part of the surroundings (50) are recorded, the flight obstacle (28, 30, 32, 34) is detected from the images and provided with an identification, and a signal (66, 68, 76) associated with the identification is outputted in a ground station (6), characterised in that detection and allocation of the identification are effected onboard the aircraft (4) and the identification is sent to the ground station (6).

2. A method according to claim 1 characterised in that a classification of a risk potential of the flight obstacle (28, 30, 32, 34) is effected on board the aircraft (4) and is sent to the ground station (6).

3. A method according to claim 1 characterised in that a measurement with respect to the flight obstacle (28, 30, 32, 34) is effected with an active measurement signal.

4. A method according to claim 1 characterised in that an avoidance trajectory (42) is ascertained on board and data associated with the avoidance trajectory (42) are communicated to the ground station (6).

5. A method according to claim 4 characterised in that the avoidance trajectory (42) is ascertained with the incorporation of items of information ascertained on board about the surroundings (50) and/or the flight situation of the aircraft (4).

6. A method according to claim 4 characterised in that a decision as to whether the aircraft (4) is to fly on the avoidance trajectory (42) is made by a control apparatus (18) on board the aircraft (4).

7. A method according to claim 1 characterised in that a detail image (38) representing the flight obstacle (28, 30) is sent to and displayed at the ground station (6).

8. A method according to claim 7 characterised in that a portion of an image used for detection of the flight obstacle (28, 30) is used as the detail image (38).

9. A method according to claim 7 characterised in that the detail image (38) is recorded in a spectral range which differs from the spectral range of the images used for detection of the flight obstacle (28, 30, 32, 34).

10. A method according to claim 1 characterised in that the images from which the flight obstacle (28, 30, 32, 34) is detected are recorded in the infrared spectral range.

11. A method according to claim 1 characterised in that a moving image of the flight obstacle (28, 30) is sent to the ground station (6).

12. An apparatus for detecting a flight obstacle (28, 30, 32, 34) in the surroundings (50) of an unmanned aircraft (4), comprising at least one camera unit (24) for recording at least a part of the surroundings (50) and an evaluation apparatus (26) for detecting the flight obstacle (28, 30, 32, 34) during the flight and associating an identification with the flight obstacle (28, 30, 32, 34), characterised in that the evaluation apparatus (26) is electrically connected to the at least one camera unit (24) and a transmitting device for sending the identification to a ground station (6).

13. Apparatus according to claim 12 characterised by a detail image unit for extraction of a detail image (38) showing the flight obstacle (28, 30) and for forwarding the detail image (38) to the transmitting device.

14. Apparatus according to claim 12 characterised by a first camera unit (24) for recording an overall image in a first spectral range and a second camera unit (36) for recording an image, such as a detail image (38) in a spectral range which is different from the first spectral range.

* * * * *